United States Patent [19]

Bilek et al.

[11] Patent Number: 5,054,399

[45] Date of Patent: Oct. 8, 1991

[54] BOMB OR ORDNANCE WITH INTERNAL SHOCK ATTENUATION BARRIER

[75] Inventors: Andrew G. Bilek, Valparaiso; Joseph C. Foster, Jr., Ft. Walton Bch.; Thomas G. Floyd, Niceville, all of Fla.

[73] Assignee: The United States of America as represented by the Secretary of the Air Force, Washington, D.C.

[21] Appl. No.: 617,292

[22] Filed: Nov. 23, 1990

Related U.S. Application Data

[63] Continuation of Ser. No. 215,082, Jul. 5, 1988, abandoned.

[51] Int. Cl.[5] ..... F42B 39/00

[52] U.S. Cl. ..... 102/481; 102/282; 102/286; 102/331; 102/473; 149/14

[58] Field of Search ..... 102/282, 286, 290, 331, 102/431, 433, 473, 481, 700; 367/152; 149/12-15

[56] References Cited

U.S. PATENT DOCUMENTS

| | | | |
|---|---|---|---|
| 1,729,550 | 9/1929 | Rupp . | |
| 2,977,885 | 4/1961 | Perry, Jr. et al. . | |
| 3,166,612 | 1/1965 | Sauer et al. | 149/12 |
| 3,485,171 | 12/1969 | Wessells . | |
| 3,563,177 | 2/1971 | Ritchey | 102/431 |
| 3,693,548 | 9/1972 | Dereich et al. . | |
| 3,765,177 | 10/1973 | Ritchey et al. . | |
| 3,830,671 | 8/1974 | McArdle . | |
| 3,847,081 | 11/1974 | Quinlan et al. | 102/431 |
| 3,893,814 | 7/1975 | McGhee . | |
| 3,927,616 | 12/1975 | Axelrod | 102/431 |
| 3,986,910 | 10/1976 | McCulloch et al. | 149/19.9 |
| 4,044,684 | 8/1977 | Gaggini . | |
| 4,131,051 | 12/1978 | Shaffling . | |
| 4,137,849 | 2/1979 | Hontgas et al. | 102/473 |
| 4,152,987 | 5/1979 | Lundstrom et al. . | |
| 4,615,272 | 10/1986 | Aubert | 102/481 |
| 4,616,152 | 10/1986 | Saito et al. | 367/152 |
| 4,838,166 | 6/1989 | Spres et al. | 102/481 |

FOREIGN PATENT DOCUMENTS

| | | | |
|---|---|---|---|
| 7193 | 4/1891 | United Kingdom | 102/700 |

OTHER PUBLICATIONS

Military Explosives, Dept. of the Army Tech. Manual, TM 9-1910, Apr. 1955, pp. 5-7, 43-53, 322.

"Practical Countermeasures for The Prevention of Spallation" by Rinehart, Colorado School of Mines Research Foundation, 2/60, pp. 87-107.

*Primary Examiner*—Harold J. Tudor

*Attorney, Agent, or Firm*—Fredric L. Sinder; Donald J. Singer

[57] ABSTRACT

An ordnance or munition casing is described which comprises a hollow outer casing having a shock attenuating inner liner made from successive layers of material of inwardly decreasing acoustic impedance. The inner liner reduces the sensitivity of the munition to sympathetic detonation and cookoff. Also described is an attenuation barrier made from a layer or layers of less detonation sensitive explosive material. The layers of less detonation sensitive material are preferably arranged in successive layers of outwardly decreasing detonation sensitivity. The same layers may combine sequenced acoustic impedance and detonation sensitivity. The layers may be made of material compounded with flaked or granular materials to provide preselected acoustic impedances. A coating for desensitizing the outer surface layer of a main explosive charge is also disclosed.

3 Claims, 1 Drawing Sheet

BOMB OR ORDNANCE WITH INTERNAL SHOCK ATTENUATION BARRIER

This application is a continuation of application Ser. No. 07/215,082, filed July 5, 1988, now abandoned.

The invention described herein may be manufactured and used by or for the Government of the United States for all governmental purposes without the Payment of any royalty.

BACKGROUND OF THE INVENTION

This invention relates generally to munitions, and more specifically to structures for reducing the sensitivity to sympathetic detonation and cookoff of single case bombs and other explosive devices that must be stored and transported under a variety of conditions prior to use.

Limits on availability of munitions at main operating bases severely impacts military readiness. Quantity and distance separation requirements, based upon a classification system according to type of explosive compound and munition design, are the primary limitations. The goal is to reduce the risk of an accidental explosion of one explosive from spreading by sympathetic detonation to adjacent explosives. A related goal is to reduce the tendency of munitions to cookoff, or explode from exposure to heat. Reducing the sensitivity of munitions to sympathetic detonation and cookoff will result in relaxed quantity and spacing limitations and permit safe storage of greater quantities of munitions at military sites.

Much work has been done to develop less sensitive explosives. Unfortunately, except for very costly explosives such as TATB, most explosive compounds are sensitive to shock detonation in relationship to their Performance; i.e., the higher the performance, the higher the sensitivity to shock initiated detonation. Further, bombs filled with so-called insensitive explosives require special and oversized boosters to initiate the main charge and still suffer a loss in performance from the lower energy of the insensitive explosive material. Also, boostering explosives are typically sensitive explosives formulated with RDX, HMX and other highly detonation sensitive materials. Therefore, to produce a bomb with so-called insensitive explosives requires a booster that is more sensitive than would normally be required. The problem of making a bomb with an insensitive bomb fill and a special, yet reliable, booster has, despite intensive research and development efforts, not been solved.

Present bombs generally have a single steel case with a thin inside coating of asphalt or Polymeric to reduce corrosion and make a barrier between various explosive compounds and the metal case. The case is filled with a main explosive charge. This design is very susceptible to detonation by both shock loading and heat.

It is thus seen that there is a need for improved ordnance and munitions that are less susceptible to sympathetic detonation and cookoff.

It is, therefore, a principal object of the present invention to provide an improved arrangement of explosives inside munitions that reduces susceptibility to sympathetic detonation and cookoff.

It is also a principal object of the present invention to provide an improved bomb casing structure that reduces susceptibility to sympathetic detonation and cookoff.

It is another object of the present invention to increase the quantity limitations and reduce the spacing requirements for safe storage and transportation of bombs and other munitions.

It is a feature of the present invention that it uses existing fuses to initiate the main charge.

It is also a feature of the present invention that its reduced susceptibility to sympathetic detonation and cookoff allows the use of more modern bomb pallets.

It is another feature of the present invention that its teachings may be easily adapted for safer commercial storage and transportation of high explosives.

It is an advantage of the Present invention that it can also enhance the blast effectiveness of the bomb or ordnance.

It is another advantage of the present invention that it increases the penetration capability of heavy case, or armor penetration, bombs against heavily reinforced targets, such as command and control bunkers or the like, by reducing premature detonation before the desired penetration.

It is another advantages of the present invention that it is simple to understand, operate and build.

SUMMARY OF THE INVENTION

In accordance with the foregoing principles, objects, features and advantages, the present invention provides a novel arrangement of explosives and a novel bomb casing structure for reducing the susceptibility of munitions to sympathetic detonation and cookoff. The unique discovery of the present invention is that layering less detonation sensitive explosive compounds over more sensitive explosive compounds inside munition casings, and adding controlled density shock attenuation barriers inside munition casings, remarkably reduces both the shock sensitivity and cookoff sensitivity of the munitions.

Accordingly, the invention is directed to an overall explosive charge for a munition comprising a main explosive charge and a plurality of successive charges of explosive material surrounding the main explosive charge in layers of outwardly decreasing detonation sensitivity.

The invention is additionally directed to an explosive charge for a munition, comprising a main explosive charge and a plurality of successive layers of explosive material surrounding the main explosive charge in successive layers both of outwardly increasing acoustic impedance and also of outwardly decreasing detonation sensitivity.

BRIEF DESCRIPTION OF THE DRAWINGS

The invention will be more clearly understood from a reading of the following detailed description in conjunction with the accompanying drawings wherein.

DETAILED DESCRIPTION

Figure 1:
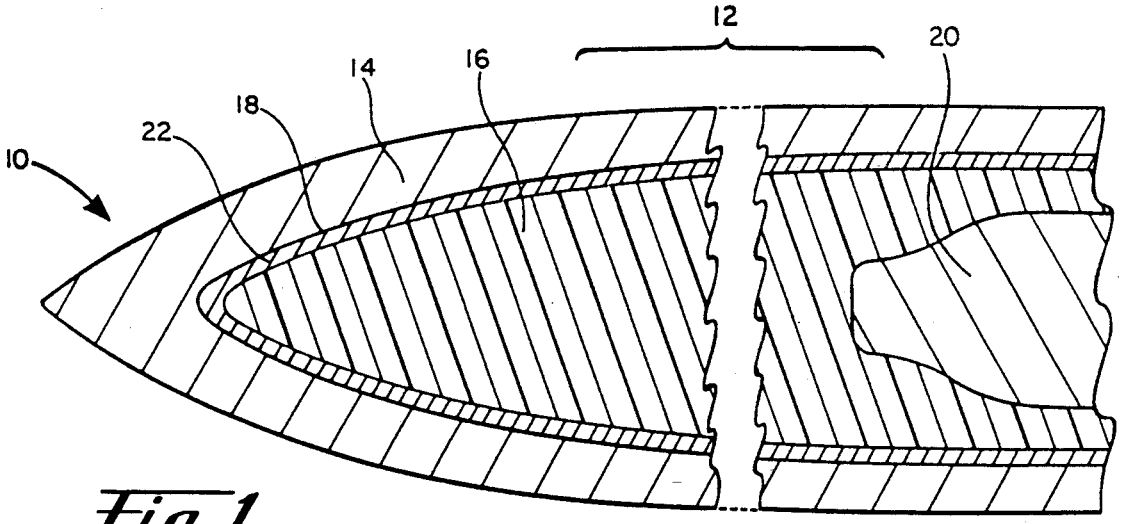
FIG. 1 is a cross-sectional view of the front end of a typical bomb casing showing the placement of a shock attenuation barrier according to the teachings of the present invention.

Referring now to FIG. 1 of the drawings, there is shown a cross-sectional view of the conical front end 10 of a typical cylindrical bomb 12. Front end 10 comprises a steel case 14 filled primarily with a main charge 16 of explosive. A corrosion barrier 18 lines case 14. A booster 20 of a more detonation sensitive explosive material is Positioned inside main charge 16 to provide sufficient energy to detonate main charge 16. A standard fuse (not shown) ignites booster 20.

Figure 2:
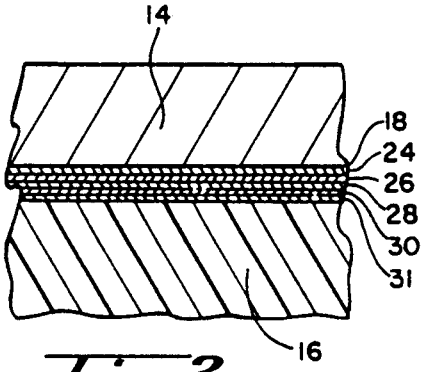
FIG. 2 is a cross-sectional view of an enlarged part area from FIG. 1 showing the successive layers of inwardly decreasing acoustic impedance making up the shock attenuation barrier.

A shock attenuation barrier 22 is Placed between corrosion barrier 18 and main charge 16. FIG. 2, an enlarged view of an area from FIG. 1, shows that shock attenuation barrier 22 comprises a plurality of successive layers 24, 26, 28, 30 and 31 of inwardly decreasing acoustic impedance. The relative thicknesses of layers 24, 26, 28, 30 and 31 are enlarged somewhat for clarity.

The acoustic impedance or resistance of a material is the product of its density and its acoustic velocity. The acoustic velocity is how fast transient stresses travel through the material. The distribution of stresses at an interface between a first and a second material is expressed by two fundamental equations.

$$\sigma_T = \frac{2\rho_2 c_2}{\rho_2 c_2 + \rho_1 c_1}\,\sigma_I$$

$$\sigma_R = \frac{\rho_2 c_2 - \rho_1 c_1}{\rho_2 c_2 + \rho_1 c_1}\,\sigma_I$$

where $\sigma$ represents stress, $\sigma_I$ represents the incident stress at the interface, $\sigma_T$ the stress transmitted into the second material, and $\sigma_R$ represents the stress reflected back into the first material. Positive values of $\sigma$ represent a compression stress, and negative values a tension stress. $\rho_1$ and $\rho_2$ represent the densities of the two materials, and $c_1$ and $c_2$ represent the two acoustic velocities.

When these two equations are solved for the case of a compression stress traveling from a first material of low acoustic impedance to a second material of much higher acoustic impedance (generally more rigid), the transmitted stress is increased to approximately twice that of the stress of the incident wave. However, when the equations are solved for the case of a compression stress traveling from a first material of higher acoustic impedance to a second material of lower acoustic impedance, the transmitted stress is less than that of the incident stress. By Passing the incident compression stress through a series of interfaces between materials of decreasing acoustic impedance, the transmitted stress is significantly reduced. Even in materials where the successive internally reflected stresses suffer only small losses as they pass through the materials and interfaces and eventually are transmitted to the last material, the spreading out of the wavefront in time produces a significant reduction in the maximum transmitted stress.

It should be noted that explosions produce shock waves of intensity and effect greater than what can be accounted for merely by replacing in the fundamental equations a variable which may be termed shock velocity in Place of acoustic velocity. And, the density of the materials may change during explosively rapid changes in heat and Pressure. However, the fundamental property that transmitted stress is attenuated or reduced by transmission through materials of successively decreasing acoustic impedance experimentally remains valid.

Returning again to shock attenuation barrier 22 shown in FIG. 1, it is seen that an accidental explosion of an adjacently stored munition will cause an impact of a shock wave, and possibly accompanying shrapnel-like fragments, against outer case 14. The resulting compression stress into ordnance 12, otherwise sufficient to detonate main charge 16, will be attenuated as it passes through shock attenuation barrier 22 so that sympathetic detonation of ordnance 12 will not occur.

Appropriate materials for layers 24, 26, 28, 30 and 31 can be selected from a variety of suitable metals, plastics and other materials according to their acoustic impedances. Values of acoustic impedance for various materials are readily available, or easily calculable as the product of density and acoustic velocity.

An advantage of using the attenuating property of shock transmission through layer of decreasing acoustic impedance is that the thickness of the layers is not a primary factor in attenuating the shock wavefront, so that a thinner overall shock attenuation barrier results than is possible with a single material.

The densities of the material layers may be controlled by use of flaked or granular materials compounded for preselected densities. Compacted aluminum flakes are a particularly good material choice. Such materials also Provide a secondary source of energy release suitable for blast enhancement.

Attenuating barrier 22 additionally provides a thermal barrier to reduce the Possibility of cookoff of main explosive charge 16.

Figure 3:
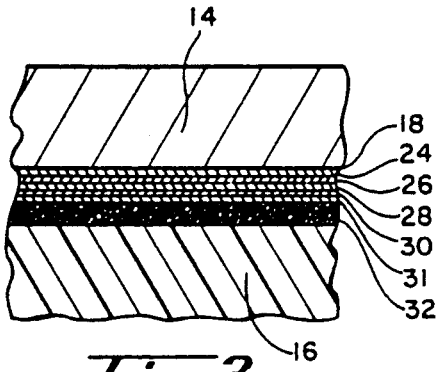
FIG. 3 is a cross-sectional view of an enlarged part area from FIG. 1 showing an additional shock attenuation barrier between the main explosive charge and the successive layers of inwardly decreasing acoustic impedance; and, FIG. 4 is a cross-sectional view of the front portion of a bomb casing showing a main charge of progressively layered, differently compounded, explosives according to the teachings of the present invention.

FIG. 3 is a cross-sectional view of an enlarged part area from FIG. 1 showing an inert shock attenuation barrier 32 added between the main explosive charge and successive layers 24, 26, 28, 30 and 31 Shock attenuation barrier 32 may comprise a separate inner casing of metal, plastic or foam.

Figure 4:
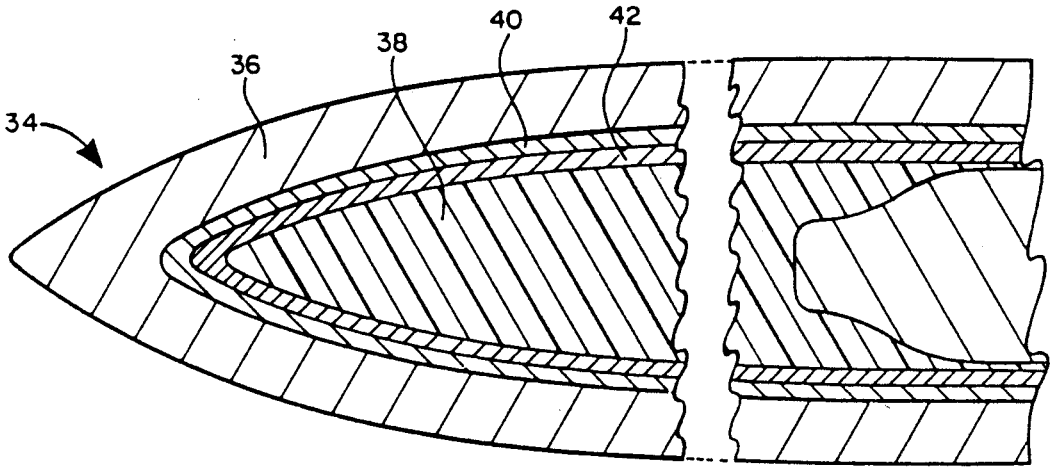

The choice of suitable barrier materials need not be limited to traditional non-energetic, or non-explosive, materials. FIG. 4 shows a cross-sectional view of the front end 34 of another ordnance case 36 showing a main explosive charge 38 surrounded by successive layers 40 and 42 of differently compounded explosives. Each layer 40 42 and main charge 38 is compounded to provide as with layers 24 26 28 30 and 31 of FIG. 1, successive layers of inwardly decreasing acoustic impedance. Additionally, layers 40 and 42 are compounded as less detonation sensitive explosives, being Preferentially successively outwardly less sensitive. Therefore, in the same manner as described in reference to FIG. 1, an externally caused shock to case 36 will be attenuated as it Passes from layer 40 to layer 42 to main charge 38 so that sympathetic detonation of main charge 38 will not occur. Further, a shock otherwise sufficient to detonate main charge 38 will not detonate the more relatively insensitive outer layers, without sacrificing the higher explosive power of main charge 38 and without requiring a special booster.

Alternatively, the Protection against detonation sensitivity provided by surrounding a main explosive charge with layers of successive outwardly less sensitive explosive materials may, besides its combination use as layers of inwardly decreasing acoustic impedance, also be used alone.

In the same manner as non-energetic materials, the densities and acoustic velocities of typical explosive materials are well known, making the selection of suitable layers straightforward.

Explosives are particularly suitable for custom blending or compounding for specific detonation sensitivities and acoustic impedances. For example, a less detonation sensitive outer layer, or layers, may be compounded with the same binder as the interior main charge, but with lower percentages of the more sensitive explosives such as RDX or HMX. As an illustration, a cast cured, or urethane, system can be loaded at 90°-100° C. with both sensitive and less sensitive explosives, such as RDX, HMX, NQ and NTO, along with aluminum Powder and/or an oxidizer such as ammonium nitrate or Perchlorate, to form a less sensitive layers. A single outer layer, varying from 1-3 inches thick depending upon the munition selected, may be formulated from 5-15% RDX, 30-70% NQ, 5-25% aluminum and 5-20% oxidizer materials. The more sensitive main charge can be detonated by a conventional fuse and the explosive force of the main charge will be then sufficient to detonate the more insensitive shock attenuating outer layer. Further, the higher percentage of aluminum in the outer layer acts as a blast improving enhancer.

Reducing the detonation sensitivity of the explosive charge of a munition may also be accomplished by coating the outer surface of the explosive charge with a suitable chemical compound to make a desensitized outer layer. A suitable example chemical for desensitizing such explosives as RDX and HMX is isododecylpelargonate, or IDP. IDP may be obtained from a number of chemical suppliers, including Eastman Kodak, Rochester, NY, and Aldrich Chemical Company, Milwaukee, WI. IDP works by desensitizing the energetic crystal components of RDX and HMX.

Those with skill in the art in the field of the invention will also see that the layers of less detonation sensitive explosives may be compounded to provide a detonation sensitivity that outwardly decreases continuously throughout each layer thickness, and is not limited to separate successive uniform layers each having through their thickness an uniform detonation sensitivity. Similarly, the described layers of inwardly decreasing acoustic impedance may include the separate layers being compounded to provide a continuously varying acoustic impedance through their depth.

Those with skill in the art will additionally se that construction considerations may require, for example, additional inner cases of plastic or metal similar to shock attenuation barrier 32, or other additional elements, without affecting the primary operation of the invention.

The disclosed barriers successfully demonstrate the use of successive layers of material of inwardly decreasing acoustic impedance and the use of a surrounding layer or layers of less detonation sensitive explosive materials to decrease the detonation and cookoff sensitivity of munitions. Although the disclosed uses are specialized, they will find application in other areas where explosive or other sensitive material needs protection from sympathetic detonation and similar hazards.

It is understood that certain modifications to the invention as described may be made, as might occur to one with skill in the field of this invention, within the scope of the claims. Therefore, all embodiments contemplated have not been shown in complete detail. Other embodiments may be developed without departing from the spirit of the invention or from the scope of the appended claims.

We claim:

1. An explosive charge for a munition, comprising:

(a) a main explosive charge;

(b) a plurality of successive layers of explosive material surrounding the main explosive charge in layers of outwardly increasing acoustic impedance; and (c) wherein the plurality of successive layers of explosive material additionally surround the main explosive charge in layers of outwardly decreasing detonation sensitivity.

2. An explosive munition, comprising:

(a) a metallic outer case having an inner wall;

(b) inside the outer case, a single main explosive charge; and, (c) in-between the outer case and the main explosive charge, a plurality of successive continuous layers of explosive material covering the inner wall of the outer case in layers of inwardly decreasing detonation sensitivity.

3. A method for reducing the detonation sensitivity of the explosive charge for a munition having a metallic outer case having an inner wall and, inside the outer case, a single main explosive charge, comprising the step of, in-between the outer case and the main explosive charge, adding successive continuous layers of explosive material covering the inner wall of the outer case in layers of inwardly increasing detonation sensitivity.

* * * * *